United States Patent [19]

Wheelock

[11] Patent Number: 4,516,980

[45] Date of Patent: May 14, 1985

[54] PROCESS FOR PRODUCING LOW-ASH, LOW-SULFUR COAL

[75] Inventor: Thomas D. Wheelock, Ames, Iowa

[73] Assignee: Iowa State University Research Foundation, Inc., Ames, Iowa

[21] Appl. No.: 506,031

[22] Filed: Jun. 20, 1983

[51] Int. Cl.[3] ..... C10L 9/02

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 3,660,054 | 5/1972 | Rieve | 44/1 SR |
| 3,993,455 | 11/1976 | Reggel et al. | 44/1 SR |
| 4,095,955 | 6/1978 | Stambaugh et al. | 44/1 SR |
| 4,254,464 | 3/1981 | Ray | 44/1 SR |

OTHER PUBLICATIONS

Crawford, BIOS Final Report No. 522, Item No. 30, Feb. 19, 1946, British Intelligence Objectives Sub-Committee, London (A.T.I.-118668, Central Documents Office, Wright-Patterson Airforce Base, Dayton, Ohio).

*Am. Chem. Soc. Div. of Duel Chem. Preprints,* 17 (1): 44–48.

Stambaugh et al., *Hydrocarbon Processing,* 54 (7): 115–116 (1975).

*Chem. Eng. Commu.,* 12: 137–159.

*Primary Examiner*—Carl F. Dees

[57] ABSTRACT

Pyritic sulfur, organic sulfur, and ash-forming minerals are removed from coal by a 2-stage alkaline treatment, using sodium carbonate or bicarbonate as the reagent. The first stage is an alkaline oxidation at moderate temperatures (130°–150° C.), and the second stage is a non-oxidizing alkaline treatment at a much higher temperature (250°–330° C.). The alkaline treated coal is extracted with an aqueous mineral acid, preferably hot aqueous sulfuric acid ($H_2SO_4$) followed by washing with hot water. The resulting low-ash, low-sulfur coal can be used as a fuel in oil-firing boilers, and for similar applications where minimal-ash content is a basic requirement.

4 Claims, 1 Drawing Figure

PROCESS FOR PRODUCING LOW-ASH, LOW-SULFUR COAL

FIELD OF INVENTION AND PRIOR ART

The field of this invention is the treatment of finely-divided coal to remove pyritic or other mineral sulfur, to reduce the organic sulfur, and to solubilize and extract the clay minerals, silica and other ash-forming minerals, thereby reducing the ash content. In particular, this invention relates to processes for treating coal with alkaline solutions, either with or without oxidation, followed by extraction with an aqueous mineral acid.

Following the end of World War II, it was learned that German coal processing plants treated coal with aqueous sodium hydroxide at elevated temperatures and pressures, and thereafter extracted the coal with aqueous hydrochloric acid. The process reduced the sulfur and ash content of the coal. See Crawford, BIOS Final Report No. 522, Item No. 30, Feb. 19, 1946, British Intelligence Objectives Sub-Committee, London (A.T-.I.-118668, Central Documents Office, Wright-Patterson Airforce Base, Dayton, Ohio).

Subsequently, the U.S. Bureau of Mines evaluated a similar process for treating coal, involving leaching with aqueous sodium hydroxide at 225° C., both with and without a final stage extraction with aqueous hydrochloric acid. In a report made by Reggel et al in 1972, it was concluded that the sequence of sodium hydroxide treatment and hydrochloric acid extraction removed most of the mineral matter originally present in the coal. *Am. Chem. Soc. Div. of Fuel Chem. Preprints,* 17 (1):44–48.

More recently, Battelle Memorial Institute has developed a similar process, which is described in Stambaugh et al U.S. Pat. No. 4,055,400 of 1977. An aqueous alkaline slurry of coal is heated at an elevated temperature and pressure to leach out sulfur and mineral matter. The Battelle process may optionally include last stage extraction with aqueous acid to reduce the final ash content. See Stambaugh et al, *Hydrocarbon Processing,* 54 (7):115–116 (1975).

An alternative process has undergone extensive development at Iowa State University, Ames, Iowa. The "Ames" process uses oxidative desulfurization in an aqueous slurry of sodium carbonate. Typical conditions are 0.2M $Na_2CO_3$ at an oxygen partial pressure of about 4 atm. and temperatures of 120°–140° C. for 1–2 hrs. This development was reviewed in detail by Dr. T. D. Wheelock in 1981. *Chem. Eng. Commun.,* 12:137–159. In one representative test, using temperatures of 120°–140° C., the total sulfur content of the coal was reduced 70% and the pyritic sulfur content was reduced 78%. Wheelock (1981), above cited, at pages 148–149.

SUMMARY OF INVENTION

The method of this invention permits the use of sodium carbonate or bicarbonate for the effective alkaline treatment of coal to remove sulfur and clay minerals. Sodium carbonate or bicarbonate has important advantages over sodium hydroxide. These alkaline reagents are lower in cost and relatively non-corrosive in aqueous solution towards steel and other common materials of construction. Further, in the acidic extraction of the solubilized sulfur and mineral matter the less expensive and less corrosive sulfuric acid can be employed instead of hydrochloric acid or nitric acid.

In a preferred embodiment, finely-divided coal is formed into a slurry with aqueous $Na_2CO_3$. In a first stage treatment, the slurry is heated at a moderate temperature under an oxygen partial pressure providing effective oxidation of the iron pyrites. At the conclusion of the first stage, the sodium carbonate slurry is subjected to a further treatment at a much higher temperature under essentially non-oxidative conditions. This combined treatment converts most of the iron pyrites and ash-forming minerals to acid-soluble compounds, which can be extracted with aqueous acid and water washing. In the preferred process, the extraction is carried out with hot sulfuric acid followed by washing with hot water, thereby maximizing the extraction and removal of the mineral matter. The low-ash, low-sulfur coal resulting from the process is well suited for coal-water mixture or coal-oil mixture fuels which can be substituted for fuel oil in boilers designed for oil-firing. With sufficiently low ash content, such coal fuel can also be used in diesel engines and gas turbines.

THE DRAWING

The process of this invention in a preferred embodiment is summarized in FIG. 1 of the accompanying drawing. As there shown, finely ground coal is charged to a pressurized oxidation reactor together with an aqueous $Na_2CO_3$ solution and compressed $O_2$ or air, and reacted therein at 120°–150° C. The slurry is transferred to an alkaline, non-oxidizing reactor and heated therein at 250°–330° C. The coal solids are then removed from the slurry by filtration, the $Na_2CO_3$ solution being passed to waste or recycle. The coal solids are then passed to a hot acid extraction reactor which is charged with dilute $H_2SO_4$ wherein the extraction is carried out at a temperature of from 75° to 100° C. The coal solids are separated by filtration, the waste $H_2SO_4$ solution will contain solubilized ash-forming minerals and sulfur. The partially extracted coal solids are then repulped and washed with hot water, the waste water containing additional solubilized ash and sulfur. The product is a low-ash, low-sulfur coal for fuel uses.

DETAILED DESCRIPTION

Figure 1:
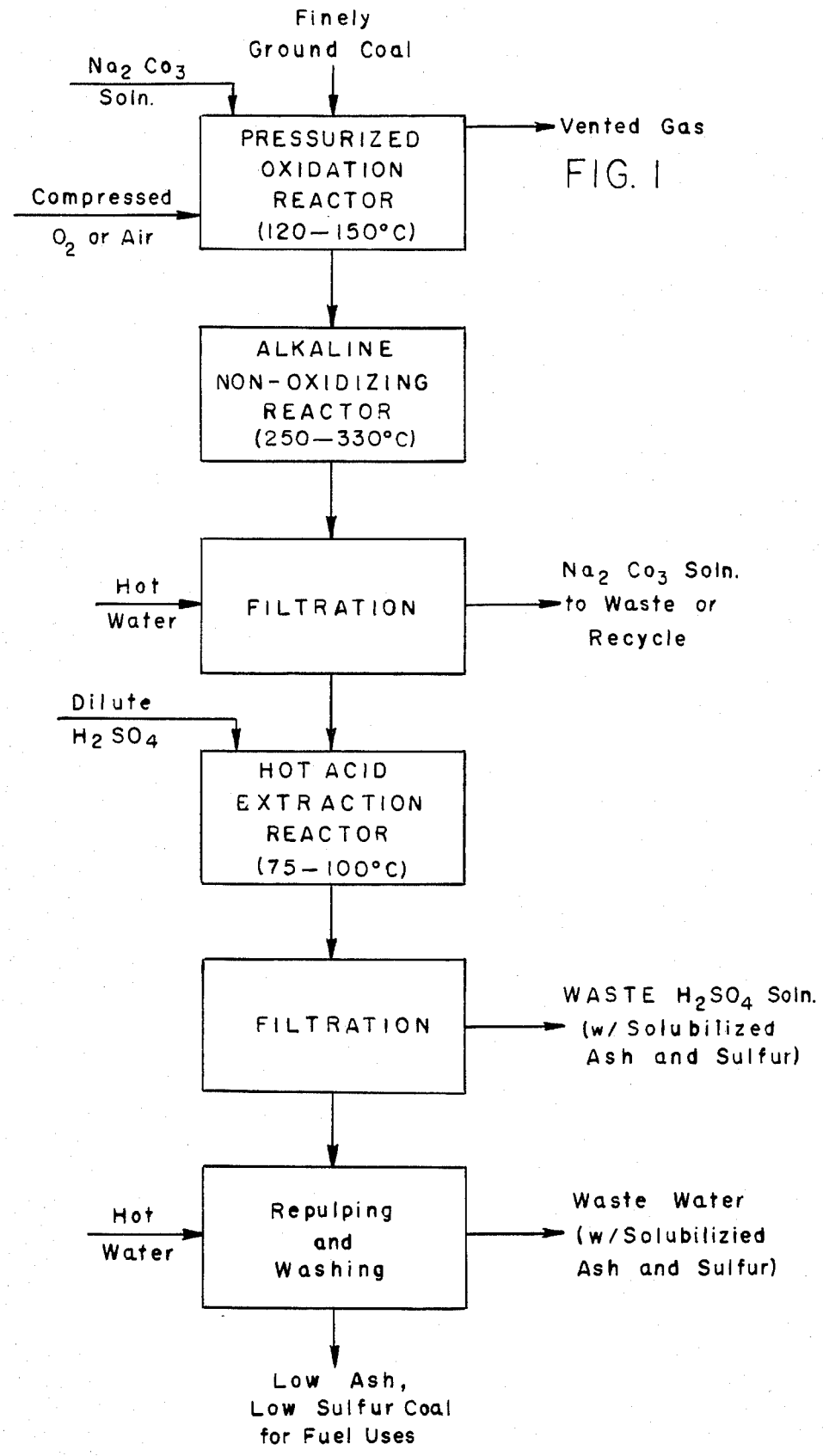

The process of this invention can be applied to any coal from which it is desired to remove sulfur and/or ash-forming minerals. It is particularly applicable to bituminous coals which have relatively high contents of sulfur and ash-forming minerals, such as coal having a pyritic sulfur content above 1% and ash-forming mineral content above 5% by weight of the coal.

For use in the process, the coal must be in a finely-divided condition, as obtained by a sequence of crushing and grinding the coal to an average mesh size of less than about 100 (U.S. Standard Screen). The coal may be cleaned by physical processes to remove large particles of pyrite and mineral matter. Such prior treatment, however, although desirable, is optional with respect to the process of the present invention.

Sodium carbonate ($Na_2CO_3$) is a preferred chemical reagent for the process of this invention. Sodium bicarbonate is an equivalent reagent, both reagents being referred to generically as the "carbonate" reagent. These reagents are used in their standard commercially-available form. The carbonate reagent is formed into a water solution having a molarity within the range from 0.2 to 3. The preferred concentration is from about 0.5 to 1.5 M. The solution is mixed with the fine coal to produce a fluid, pumpable slurry. The solids content of the slurry is not critical, but may range from about 5 to 30% based on the slurry.

The preformed slurry, or a slurry formed in the initial reactor, is subjected to a pressurized oxidation. For this treatment, the aqueous phase of the slurry must contain sufficient dissolved oxygen to promote the desired oxidative desulfurization. The reaction may be carried out under an oxygen atmosphere at a pressure of from 50 to 200 psia. The oxygen-providing gas may be supplied continuously to maintain the desired $O_2$ partial pressure. If the atmosphere is air, or air enriched with oxygen, the total pressure will be higher, but the oxygen partial pressure should be within the range stated. Where pressurized air is used, continuous venting of the waste air is needed. The slurry is preferably agitated during the reaction, and the temperature of the slurry is controlled to a temperature within the range from 120° to 150° C. The reaction can be completed within 1 to 2 hours under these conditions. Substantially all of the pyritic sulfur and part of the organic sulfur will be converted to soluble forms.

The next stage of the alkaline treatment is carried out under substantially non-oxidizing conditions. For a batch operation, the second stage may be carried out in the same reactor with no air or oxygen being pumped into the reactor. Some oxygen can remain in the atmosphere above the slurry, since that atmosphere will be rapidly saturated with steam at high pressure. Preferably, the slurry without separation of the sodium carbonate solution is passed to a second reactor equipped with heating and stirring means. The slurry is agitated in the closed reactor at a temperature of from about 250° to 330° C. The pressure is that of steam in equilibrium with the alkaline solution at the reaction temperature. Essentially non-oxidizing conditions are maintained, by the steam atmosphere. Under these conditions, the second stage reaction can be completed in about 1 to 2 hours.

In a process variation, the carbonate leach solution is separated after the first stage, and the coal solids are resuspended in a carbonate slurry of the same reagent and solids concentration.

Following completion of the alkaline treatments, the coal solids are separated by filtration or centrifugation. The heat can be recovered from the separated sodium carbonate solution, and the solution can be recycled for further treatment of the coal. Make-up sodium carbonate can be added as required. The carbonate solutions as separated from the coal will contain solubilized sulfur compounds and can be treated to remove these compounds before recycle.

The coal solids are then extracted with an aqueous mineral acid. While hydrochloric or nitric acids may be used, the preferred acid is sulfuric acid ($H_2SO_4$). The mineral acids are used at relatively dilute concentrations such as from 0.5 to 5 molarity. A preferred concentration for the aqueous $H_2SO_4$ is from 1 to 3M. Where the extraction is carried out with hydrochloric or nitric acid, the acidic extracting solution may be at ambient temperature (20°–25° C.). However, when the preferred sulfuric acid solution is employed, elevated temperatures are important to obtain maximum extraction of the sulfur and mineral matter. Analcite and natrodavyne are formed from kaolinite or similar clay minerals by the 2-stage alkaline treatment. Analcite is less soluble in aqueous acid than natrodavyne. Further, when analcite and natrodavyne are treated with sulfuric acid some tamarugite is formed. Tamarugite is difficultly soluble. By using hot sulfuric acid for the extraction, analcite, natrodavyne, and tamarugite can be effectively extracted, especially if following the acid extraction, the coal solids are repulped with hot water and agitated to dissolve the tamarugite.

The aqueous sulfuric acid extraction should be carried out at a temperature above 75° C., such as, preferably, a temperature from 90° C. to the atmospheric boiling temperature of the solution. Similarly, the water wash is preferably carried out at a temperature above 75° C., such as a temperature in the range from 90° to 100° C.

Following the hot wash, the resulting low-ash, low-sulfur coal is ready for commercial use.

The process of this invention and the results obtainable thereby can be more fully appreciated by the following examples.

EXPERIMENTAL EXAMPLES

A series of tests were carried out with a lower Kittaning coal having a −200 mesh size, and ash content of 17.87% and a total sulfur content of 10.61%. The experimental procedure was as follows.

Preoxidation Step

1. A 300 ml., stirred, stainless steel autoclave was charged with 15 g. of coal plus 120 ml. of sodium carbonate solution and sealed.

2. The autoclave was purged with nitrogen gas while being heated up to the desired reaction temperature (150° C.).

3. When the operating temperature was reached, the flow of nitrogen was stopped and oxygen was introduced into the autoclave to start the preoxidation step.

4. During the preoxidation step, gas was bled continuously from the autoclave at a rate of 0.042 $m^3/h$ to avoid any build-up of gaseous reaction products in the system.

5. The oxygen partial pressure was held constant at 200 psia (13.6 atm.) for 1 hr. of reaction time. The total pressure was also held constant at 252 psig.

6. At the end of the preoxidation step, the flow of oxygen was stopped.

(a) The temperature of the reactor was increased and the alkaline leaching step was carried out directly. This alternative was adopted when the same leaching solution was used for both the preoxidation step and the alkaline leaching step.

Alkaline Leaching Step

1. The coal slurry treated in the preoxidation step was leached in the 300 ml. stirred autoclave.

2. The autoclave was flushed with nitrogen and charged with nitrogen to a pressure of 5.00 atm. or more.

3. The reactor was heated to an operating temperature in the range of 200° to 360° C. and held at the desired operating temperature for a specified time (usually 1 hr.). During this treatment the total pressure was approximately equal to the vapor pressure of water at the given operating temperature.

4. After the preceding treatment, the reactor was cooled quickly and the coal recovered by filtration. The filter cake was washed with water, dried for 4 hr. in an oven at 95° C., weighed, and sampled for chemical analysis.

5. A portion of the coal from the preceding step was subjected next to an acid leaching step.

Acid Leaching Step

1. The acid leaching step was conducted in a stirred, three-neck Pyrex reaction flask fitted with a reflux condenser. Generally 3 g. of treated coal was leached with 300 ml. of approximately 2 M mineral acid for 0.5 hr. The acid leaching was conducted either at room temperature (25° C.) or at the boiling point (100° C.).

2. After leaching with acid, the coal was recovered by filtration and the cake was washed with 600 ml. of water, dried, weighed, and sampled for chemical analysis. In some cases washing was conducted with boiling water whereas in other cases washing was conducted with water at room temperature.

Comparisons of the cleaning of the lower Kittaning coal with and without the preoxidation step are summarized below in Table A.

TABLE A

Comparism of Cleaning of Lower Kittaning Coal With and Without Preoxidation

| | Preoxidation Step | | | Alkaline Leaching Step | | | Acid Extraction Step | | | Water Washing | Product | | |
|---|---|---|---|---|---|---|---|---|---|---|---|---|---|
| Run | $Na_2CO_3$ M | Temp. °C. | $O_2$ psia | $Na_2CO_3$ M | Temp. °C. | Press. psig | Type | Conc. M | Temp. °C. | Temp. °C. | Yield % | Ash % | Tot. S % |
| (1) | 1.0 | 150 | 200 | 1.0 | 250 | 612 | $H_2SO_4$ | 1.8 | 100 | 100 | 85.3 | 3.21 | 1.96 |
| (2) | — | — | — | 1.0 | 250 | 612 | $H_2SO_4$ | 1.8 | 100 | 100 | 89.2 | 10.05 | 8.01 |
| (3) | 1.0 | 150 | 200 | 1.0 | 250 | 612 | $H_2SO_4$ | 1.8 | 25 | 25 | 85.3 | 5.69 | 1.93 |
| (4) | — | — | — | 1.0 | 250 | 612 | $H_2SO_4$ | 1.8 | 25 | 25 | 89.1 | 13.34 | 7.73 |
| (5) | 1.0 | 150 | 200 | 1.0 | 250 | 612 | HCl | 2.0 | 100 | 25 | 85.0 | 2.38 | 1.49 |
| (6) | — | — | — | 1.0 | 250 | 612 | HCl | 2.0 | 25 | 25 | 89.0 | 9.44 | 7.70 |
| (7) | 0.5 | 150 | 200 | 0.5 | 250 | 612 | HCl | 2.0 | 100 | 25 | 84.6 | 2.41 | 1.41 |
| (8) | 1.0 | 150 | 200 | 1.0 | 250 | 612 | $H_2SO_4$ | 1.8 | 100 | (see discussion) | 85.1 | 2.74 | 1.55 |

As will be noted from the product data shown in the above table, where the preoxidation step was omitted, either with sulfuric acid or hydrochloric acid extraction, and under conditions otherwise the same, the product contained a much higher amount of ash. This indicated that the clay minerals were incompletely solubilized and extracted. Further, there was incomplete solubilization and extraction of the sulfur. The comparative data also shows the importance of utilizing a high temperature for the sulfuric acid extraction (100° C.) followed by a high temperature water washing (100° C.) for maximized reduction of the ash and sulfur.

Run 8 demonstrated the benefits of repulping the acid-leached coal with hot water to complete the dissolution of tamarugite. In this run the usual experimental procedure was modified following the acid leaching step. Thus after the acid-leached coal was washed with water, the filter cake was repulped with water and heated in a stirred Pyrex flask for 30 min. to complete the dissolution of the tamarugite. The coal was then recovered by filtration and the filter cake washed further with water. The ash and sulfur contents of the product were both lower than the ash and sulfur contents of the product obtained in run 1. Also the sulfur content of the product from run 8 was virtually the same as that of the product from run 5 which involved leaching with hot hydrochloric acid. Since leaching with hydrochloric acid does not produce tamarugite, these results show that the extended treatment with hot water of the sulfuric acid-leached coal effectively removed the tamarugite.

I claim:

1. The process of treating finely ground coal for removal of pyritic sulfur, organic sulfur, and ash-forming minerals, including the steps of treating the coal in an aqueous alkaline solution at an elevated temperature followed by extraction with an aqueous acidic solution, wherein the improvement comprises:

(a) forming a slurry of finely-divided coal with an aqueous solution of a carbonate reagent selected from the class consisting of sodium carbonate and bicarbonate, and heating said slurry in a pressurized reactor while in contact with dissolved oxygen, said reactor being maintained at a temperature of from 120° to 150° C. and at an oxygen pressure or partial pressure of 50 to 200 psia;

(b) next heating the coal from step (a) in an aqueous slurry of said carbonate reagent at a temperature of from 250° to 330° C. under substantially non-oxidizing conditions; and (c) after separating the coal from the slurry of step (b) carrying out an aqueous acidic extraction with a strong mineral acid to solubilize ash-forming minerals.

2. The process of claim 1 in which step (c) is carried out by extracting said coal with aqueous sulfuric acid ($H_2SO_4$) at a temperature above 75° C.

3. The process of claim 2 in which following step (c) the coal is separated from the aqueous $H_2SO_4$ and washed with water at a temperature above 75° C. to remove additional sulfur compounds and solubilized minerals.

4. The process of treating finely ground coal for removal of pyritic sulfur, organic sulfur, and ash-forming minerals, including the steps of treating the coal in an aqueous alkaline solution at an elevated temperature followed by extraction with an aqueous acidic solution, wherein the improvement comprises:

(a) forming a slurry of finely-divided coal with an aqueous solution of sodium carbonate ($Na_2CO_3$) and heating said slurry in a pressurized reactor while in contact with dissolved oxygen, said reactor being maintained at a temperature of from 120° to 150° C. and at an oxygen pressure or partial pressure of 50 to 200 psia;

(b) without separating said coal from the aqueous solution of $Na_2CO_3$ in said slurry heating said slurry at a temperature of from 250° to 330° C. under substantially non-oxidizing conditions;

(c) after separating the coal from said slurry carrying out said acidic extraction by contacting the coal with aqueous sulfuric acid ($H_2SO_4$) at a temperature of from 90° C. to the atmospheric boiling temperature of the $H_2SO_4$ solution; and (d) after separating the coal from the $H_2SO_4$ solution washing said coal with water at a temperature of from 90° to 100° C.

* * * * *